US010508458B1

(12) United States Patent
Charitou

(10) Patent No.: US 10,508,458 B1
(45) Date of Patent: Dec. 17, 2019

(54) TILE ALIGNMENT AND LEVELING DEVICE AND METHOD FOR USING SAME

(71) Applicant: Michael Charitou, Mt. Kisco, NY (US)

(72) Inventor: Michael Charitou, Mt. Kisco, NY (US)

( * ) Notice: Subject to any disclaimer, the term of this patent is extended or adjusted under 35 U.S.C. 154(b) by 0 days.

(21) Appl. No.: 15/995,855

(22) Filed: Jun. 1, 2018

(51) Int. Cl.
*E04F 21/00* (2006.01)
*E04F 15/02* (2006.01)
*E04F 21/20* (2006.01)
*E04F 21/18* (2006.01)

(52) U.S. Cl.
CPC .... *E04F 21/0092* (2013.01); *E04F 15/02022* (2013.01); *E04F 21/1877* (2013.01); *E04F 21/20* (2013.01)

(58) Field of Classification Search
CPC ..... E04F 15/0092; E04F 15/02022; E04F 21/1877; E04F 21/20; E04F 21/22
USPC ..... 52/98, 99, 111, 125.4, 126.1, 126.5, 52/127.12, 744.11, 749.11; 33/526, 527, 33/533, 613, 645; 411/512
See application file for complete search history.

(56) References Cited

U.S. PATENT DOCUMENTS 3,537,146 A * 11/1970 Caveney ..... B65D 63/1072 24/16 PB
4,286,497 A * 9/1981 Shamah ..... F16B 37/04 411/342
4,397,125 A * 8/1983 Gussler, Jr. ..... E04F 21/0092 52/127.3
4,865,501 A * 9/1989 Ferris ..... F16B 13/0808 411/340
4,897,899 A * 2/1990 Shely ..... B65D 63/1072 24/16 PB
5,359,783 A 11/1994 Smith
5,584,452 A * 12/1996 Koike ..... F16L 3/127 24/16 PB
5,601,261 A * 2/1997 Koike ..... B60R 16/0215 24/16 PB
5,603,195 A * 2/1997 Cosentino ..... E04F 13/0892 52/749.11
6,347,435 B1 * 2/2002 Davignon ..... B65D 63/1063 24/16 PB (Continued)

OTHER PUBLICATIONS

PCT International Search Report and Written Opinion corresponding to PCT/US2019/035110 dated Jul. 5, 2019.

*Primary Examiner* — Joshua J Michener
*Assistant Examiner* — James J Buckle, Jr.
(74) *Attorney, Agent, or Firm* — Carter, Deluca & Farrell LLP; George Likourezos, Esq.

(57) ABSTRACT

A tile leveling and alignment system for use in aligning and leveling a plurality of tiles, comprising a tile leveling and aligning device, a vertical leveling hand device, a horizontal leveling device and an optional slip ring/spacer device. The tile leveling and aligning device comprising a base portion integrally coupled to a stem portion projecting upwards from the base portion. The base portion adapted for engaging a bottom surface of a number of tiles to be leveled and aligned. The stem portion comprising a central aperture and one or more spacer legs or fins, each spacer leg extending transversely from the central aperture. Each spacer leg defining a joint width between adjacent tiles to be leveled and aligned. Each spacer leg dividing the tile leveling and aligning device into equal sized areas of common shape and defining a joint width between adjacent tiles to be leveled and aligned.

20 Claims, 6 Drawing Sheets

(56) References Cited

U.S. PATENT DOCUMENTS 6,578,239 B2 * 6/2003 Hatch ..... B65D 63/1027 24/16 PB
6,625,951 B1 * 9/2003 McCarthy ..... E04D 11/007 156/297
6,658,703 B1 * 12/2003 Teagno ..... F16L 3/2332 24/16 PB
6,769,191 B1 8/2004 Zusman
7,257,926 B1 * 8/2007 Kirby ..... E04F 21/0092 33/526
7,520,030 B2 * 4/2009 Laporte ..... B65D 63/1063 24/16 PB
7,946,093 B1 5/2011 Sturino
8,607,530 B2 * 12/2013 Hoffman ..... E04F 21/00 52/747.11
8,635,815 B2 1/2014 Bordin
8,671,628 B2 * 3/2014 Sighinolfi ..... E04F 15/02022 33/527
8,887,475 B2 * 11/2014 Ghelfi ..... E04F 21/0092 52/749.11
9,097,026 B2 * 8/2015 Hoffman ..... E04F 21/22
9,260,872 B2 * 2/2016 Bunch ..... E04F 21/0092
9,328,522 B2 5/2016 Bordin
D760,566 S * 7/2016 Biec ..... D8/47
9,470,003 B1 10/2016 Moon
9,487,959 B2 * 11/2016 Bunch ..... E04F 21/1844
9,534,403 B2 * 1/2017 Biec ..... E04F 21/0092
9,689,167 B2 6/2017 Teng
9,970,203 B1 * 5/2018 Abidov ..... E04F 21/0092
D821,838 S * 7/2018 Castellanos ..... D8/47
10,024,068 B1 * 7/2018 Chen ..... E04F 21/0092
2003/0177613 A1 * 9/2003 Caveney ..... B65D 63/1036 24/16 PB
2008/0236094 A1 * 10/2008 Doda ..... E04F 13/0892 52/749.11
2010/0186344 A1 * 7/2010 Jones ..... E04F 21/22 52/749.1
2013/0104497 A1 5/2013 Ross
2015/0184355 A1 7/2015 Wang
2015/0211243 A1 7/2015 Irvine et al.
2015/0211244 A1 7/2015 Kufner et al.
2018/0080237 A1 3/2018 Chen

* cited by examiner

TILE ALIGNMENT AND LEVELING DEVICE AND METHOD FOR USING SAME

TECHNICAL FIELD

The present application generally relates to the field of laying and leveling tiles. More particularly, the invention is directed to a device for aligning and leveling tiles as they are laid in floors, walls, countertops, or the like.

BACKGROUND

Tiling is a laborious and time intensive endeavor. Tile installers spend a great deal of time aligning and leveling tiles as the tiles are being placed on a substrate's surface. Proper alignment, spacing and leveling of each tile is important because if one tile is improperly placed the error will propagate in adjacent tiles making the entire installation unacceptable. Laying and leveling tile can also be difficult to perform because many substrates are uneven.

Tile installers have used a variety of devices and methods to maintain quality tile installation while completing the installation process. However, conventional devices and techniques are labor intensive, expensive, time consuming and inefficient. For example, commercial systems on the market use a separate base for every grout or spacer size, requiring the purchase of a different base for each grout size.

SUMMARY

The present disclosure relates to improving the aligning, spacing and leveling of adjacent tiles as they are laid in floors, walls, countertops, and the like. The present disclosure provides significant and non-obvious advantages over the foregoing disadvantages inherent in the prior art by providing an improved tile spacer and levelling device to assist installers to properly space and align a plurality of floor tiles to a uniform consistent width from adjacent tiles.

The present disclosure is directed to a tile leveling and alignment device, system, and method for use in aligning and leveling a plurality of tiles that are being secured to any suitable substrate, such as floors, walls, countertops, or the like.

According one exemplary embodiment disclosed herein, a tile leveling and aligning device comprises a main body comprising a base portion integrally coupled to a stem portion projecting upwards from the base portion. The base portion being adapted for engaging a bottom surface of a number of tiles to be leveled and aligned. The stem portion comprising a central aperture, which may be threaded, and one or more spacer legs or fins, each spacer leg extending transversely from the central aperture. Each spacer leg including external threads integrally formed on an outer face, defining a joint width between adjacent tiles to be leveled and aligned. Each of the equal sized areas being adapted to receive a corner of a tile, and dividing the tile leveling and aligning device into equal sized areas of common shape. Each spacer leg defines a joint width between adjacent tiles to be leveled and aligned.

According to a further aspect of one exemplary embodiment disclosed herein, a horizontal leveling device is provided. The horizontal and leveling device is adapted and configured to perform horizontal alignment of a number of tiles to be leveled and aligned. The horizontal leveling device comprises a locking-nut or the like for engaging the external threads of the spacer legs of the stem portion of the tile leveling and aligning device to cause adjacent tiles be drawn down into a properly spaced relative horizontal arrangement. By applying a circular or rotational horizontal leveling force directly to the stem portion of the tile leveling device, via engagement with the horizontal leveling device, the tops of the tiles are horizontally aligned together in the same plane into a properly spaced relative horizontal arrangement with minimal or no slippage.

According to a still further aspect of one exemplary embodiment disclosed herein, a vertical leveling hand device is provided. The vertical leveling hand device is adapted and configured to perform a horizontal alignment of a number of tiles to be leveled and aligned. In those cases where it is determined that the tiles must be raised vertically to bring them in line with the horizontal, the vertical leveling hand device is adapted and configured to impart an upward vertical force on the tiles. In an embodiment, the vertical leveling hand device comprises a T-bar having a stem gripping portion for gripping the stem, and a threaded tile leveler engagement portion for threaded (or non-threaded) engagement with the stem portion of the tile leveling device. In operation, engagement of the T-bar engagement portion with the stem portion of the tile leveling device imparts a vertical force on a portion of the substrate directly beneath the tiles to be aligned causing the tiles to be driven in the vertical direction thereby causing leveling of the tiles so that adjacent tiles are leveled relative to themselves without regard to whether the substrate material is level. The force applied by the vertical leveling hand device holds the tiles at the same height so that corners and/or edges of the adjacent tiles remain level in the setting bed as the setting bed dries and cures. After the setting bed dries, thereby securing the tiles to the substrate, the stem portion can be separated from the bottom plate leaving the bottom plate beneath the set tiles.

According to a still further aspect of the one exemplary embodiment disclosed herein, an optional slip ring/spacer device is provided. The slip ring/spacer device is adapted and configured for dual use, first as a slip ring/spacer in a first orientation and for exclusive use as a slip ring in a second orientation. The slip ring feature of the device substantially eliminates horizontal shifting of a number of tiles to be leveled and aligned as they are being horizontally aligned by the horizontal leveling device, as described above. In operation, the slip ring is placed directly over the stem portion of the tile leveling and aligning device directly beneath the horizontal leveling device and is seated on top of a number of tiles to be leveled and aligned surrounding the tile leveling device. In an embodiment, the slip ring/spacer device comprises a circular disk including a hollowed cross-sectional area and four integrally molded raised protrusions formed at a bottom side of the device for non-edge applications. In one embodiment the slip ring/space comprises a circular disk including a hollowed cross-sectional area and two integrally molded raised protrusions formed at a bottom side of the device for edge applications. In each of the described embodiments, the raised protrusions have a common length and are circumferentially and equidistantly spaced about the periphery of a bottom side of the device. The spacer feature of the device provides flexibility by providing spacings greater than 1/16" which cannot be realized by the tile leveling device alone which is best suited to provide tile spacing of 1/16" by the nature of its construction. When used in a first orientation as a spacer, the integrally molded raised rectangular protrusions are oriented to face towards the tiles. The slip ring/spacer device is manufactured with a range of rectangular protrusion widths according to different desired tile spacings (e.g., 1/8", 1/4", 1/2, etc).

According to one aspect of the exemplary embodiments disclosed herein, the stem portion includes a number of vertical legs or projections corresponding to the number of tiles to be leveled.

According to one aspect of the exemplary embodiments disclosed herein, the vertical projections (spacer fins) of the stem portion of the tile leveling device include a frangible breakaway section to facilitate breakaway from the base portion after the tiles have been set.

According to one aspect of the exemplary embodiments disclosed herein, the stem portion is frangibly molded onto the base portion at a breakage point at the time of fabrication.

According to one aspect of the exemplary embodiments disclosed herein, the optional slip ring/spacer is made from a non-conductive material, such as a hard plastic and may have an external cylindrical shape including one or more through slits to slip over the one or more vertical legs of the spacer member. In the particular case of leveling four vertical legs, the slits of the slip ring/spacer form a hollowed cruciform or cross-shaped configuration.

According to one aspect of the exemplary embodiments disclosed herein, the tile alignment and leveling device may be constructed of any suitable material, and is comprised of a plastic material which may be readily produced, such as by molding.

According to one aspect of the exemplary embodiments disclosed herein, a method for aligning and leveling tiles being secured to a suitable substrate comprises steps of: applying a setting bed, placing a plurality of tiles in the setting bed, positioning the tile device at an intersection of two, three or four adjacent tiles in the setting bed, such that each tile abuts a corner of a stem portion of a tile device thereby spacing the two, three or four adjacent tiles to be aligned at a predetermined distance with respect to each other, applying a circular or rotational horizontal leveling force to the stem portion, via a horizontal leveling device, to cause the top of the tiles to be horizontally aligned together in the same plane with minimal or no slippage, thereafter applying a vertical force to the substrate beneath the tiles to be leveled, via a vertical leveling hand device, resulting in a counter force thereby lifting or lowering the tiles in a vertical direction to cause alignment of the tiles.

The method further comprising steps of: separating the spacer member of the plurality of tiles devices from the base plate member leaving the base plate member beneath the set tiles.

The present disclosure also relates to a tile leveling and aligning system, according to an exemplary embodiment, comprising: a tile leveling and aligning device comprising a main body comprising a base portion integrally coupled to a stem portion, the base portion adapted for engaging a bottom surface of a number of tiles to be leveled and aligned, the stem portion projecting upwards from the base portion and having one or more spacer legs extending transversely from a center aperture of the stem portion, each spacer leg having a series of external threads integrally formed on an outer face, the one or more spacer legs dividing the base portion into equal sized areas of common shape, each of the equal sized areas adapted to receive a corner of one of the tiles to be leveled and aligned, each spacer leg defining a joint width between adjacent tiles to be leveled and aligned, a horizontal leveling device for engaging a top surface of the number of tiles to be horizontally leveled and aligned, the first horizontal leveling device adapted and configured to engage the spacer legs formed on the outer face of the stem portion of the tile leveling and aligning device, the engagement resulting in a single connected assembly comprising the tile leveling and aligning device, the horizontal leveling device and the number of tiles to be leveled and aligned, a vertical leveling hand device adapted for imparting a vertical force on a substrate beneath the number of tiles to be leveled and aligned, the vertical force causing the single connected assembly to be driven upwards away from the substrate resulting in a vertical alignment of the tiles.

The present disclosure also relates to a tile leveling and aligning system, according to a further exemplary embodiment, comprising a tile leveling and aligning device comprising a main body comprising a base portion integrally coupled to a stem portion, the base portion adapted for engaging a bottom surface of a number of tiles to be leveled and aligned, the stem portion projecting upwards from the base portion and having one or more spacer legs extending transversely from a center aperture of the stem portion, each spacer leg having a series of external threads integrally formed on an outer face, the one or more spacer legs dividing the base portion into equal sized areas of common shape, each of the equal sized areas adapted to receive a corner of one of the tiles to be leveled and aligned, each spacer leg defining a joint width between adjacent tiles to be leveled and aligned, a first horizontal leveling device for engaging a top surface of the number of tiles to be horizontally leveled and aligned, the first horizontal leveling device adapted and configured to engage the spacer legs formed on the outer face of the stem portion of the tile leveling and aligning device, the engagement resulting in a single connected assembly comprising the tile leveling and aligning device, the horizontal leveling device and the number of tiles to be leveled and aligned, a vertical leveling hand device comprising a ring-shaped element including four integrally connected vertical legs having an equidistant relative spacing on the ring-shaped element, the vertical leveling hand device adapted to be placed over the first horizontal leveling device, a second horizontal leveling device for placement over the second vertical leveling hand device, the second horizontal leveling device adapted and configured to engage a top portion of the spacer legs formed on the outer face of the stem portion of the tile leveling and aligning device, the engagement resulting in a single connected assembly comprising the second horizontal leveling device, the second vertical leveling hand device, the first horizontal leveling device and the number of tiles to be leveled and aligned, A plurality of devices of the present disclosure can be simultaneously used between numerous tiles being laid on a substrate so that all the tiles on the substrate are level and aligned relative to each other.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
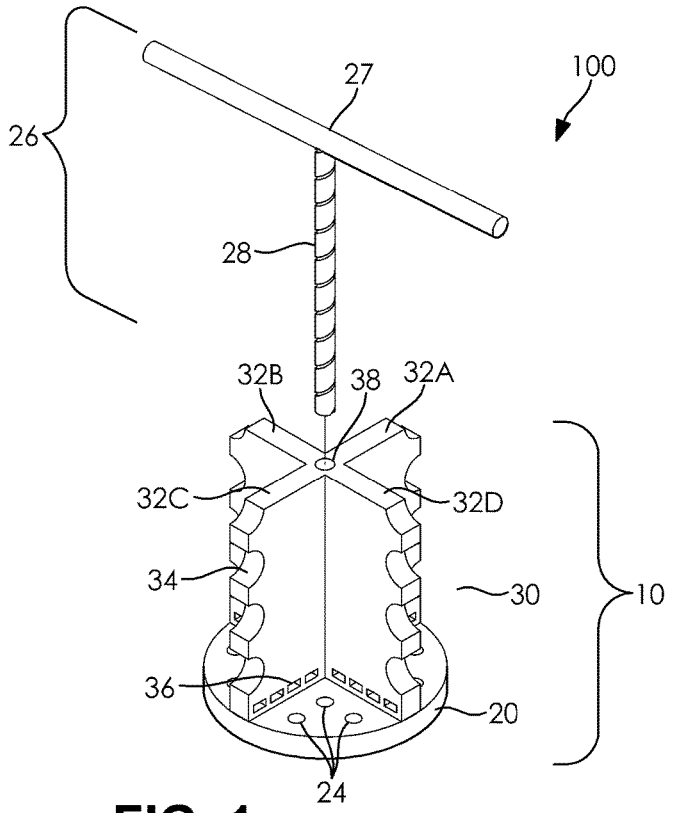
FIG. 1 is a perspective view of a tile spacer and leveling system in accordance with an embodiment of the disclosure.

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

The terminology used herein is for the purpose of describing particular embodiments only and is not intended to be limiting of embodiments disclosed herein. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The examples of the methods and systems discussed herein are not limited in application to the details of construction and the arrangement of components set forth in the following description or illustrated in the accompanying drawings. The methods and systems are capable of implementation in other embodiments and of being practiced or of being carried out in various ways. Examples of specific implementations are provided herein for illustrative purposes only and are not intended to be limiting. Also, the phraseology and terminology used herein is for the purpose of description and should not be regarded as limiting. Any references to examples, embodiments, components, elements or acts of the systems and methods herein referred to in the singular may also embrace embodiments including a plurality, and any references in plural to any embodiment, component, element or act herein may also embrace embodiments including only a singularity. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

A novel system, device and method is provided for aligning and leveling adjacent tiles as they are laid in floors, walls, countertops, or the like, which overcomes one or more drawbacks of known devices. More specifically, according to some embodiments, the present disclosure provides for a more efficient, less expensive and more reliable tile spacer and leveling system that provides both the proper grout (i.e., horizontal) spacing between tiles and proper vertical leveling of the tiles, which enhances the ease of installation. Further, the present disclosure produces a better aligned tile surface which lowers the repair cost of mislaid tile. A feature of the present disclosure is that a portion of the tile alignment and leveling device will remain in the adhesive layer (setting bed) between the tile joints when the floor is grouted providing an invisible and consistent installation.

It should be appreciated that the system, device and method of the present invention is not limited to use with floor tiles. As used herein, references to tiles include, for example, traditional thin rectangular slabs of baked clay, concrete, or other material for covering floors or, more generally, substrates of any material including wood, finishing boards, or metal or the like used to cover a substrate, such as a horizontal surface or a vertical surface, such as a wall.

Referring to FIGS. 1-6, a system 100 of the present disclosure according to one embodiment, comprises, a tile spacer device 10 used to lay tiles 40 a set distance from each other at a consistent width and height, a horizontal leveling device 56 for use as a tensioning element to align the tiles horizontally, a vertical leveling hand device 26 used to adjust the tiles vertically and an optional slip ring/spacer device 50, is adapted and configured for use as a slip ring to eliminate any horizontal shifting of the tiles as they are being horizontally aligned by the horizontal leveling device 56 and is further adapted and configured as a spacer to provide additional grout spacing beyond what is provided by the tile spacer device 10.

As best shown in FIG. 1, the tile spacer device 10 comprises a main body comprised of a base portion 20 and a stem portion 30 which projects upwardly from a top of the base portion 20. The stem portion 30 including a central threaded orifice 38 for engagement with a threaded stem portion 28 of a vertical leveling hand device 26. The base portion 20 and stem portion 30 of the main body of the tile spacer device 10 are preferably manufactured as a single integral unit and designed to be typically placed at the intersection of four adjacent tiles 40 to be aligned and leveled. The tile spacer device 10 is also envisioned for use to space other than four adjacent tile, e.g., two or three adjacent tiles, for example at corner and end applications. In such applications, the number of vertical projections 32*a-d*, (i.e., spacer fins) of the stem portion may be less than the four (4) shown in FIG. 1. In the presently described embodiment, the stem portion 30 of the tile spacer device 10 includes four vertical equidistant projections 32*a-d* which extend outwardly from the central threaded orifice 38 resulting in a stem portion 30 with a regular (symmetrical) cross-shaped profile. In the case where four vertical equidistant projections 32*a-d* are used, the equidistant projections 32*a-d* are equidistantly located at ninety degree (90°) angles from each other. In the case where two vertical equidistant projections 32*a-d* are used, the equidistant projections 32*a-d* are equidistantly located at one hundred and eighty degree (180°) angles from each other. The vertical projections 32*a-d* are substantially 1.5" in height, but may be greater or less than 1.5" in other embodiments. Typical widths of the vertical projections 32*a-d* envisioned for use are, 1/16", 3/16" and 1/2", however other widths are within contemplation of the present disclosure as determined by a desired tile spacing (e.g., 1/8" to 3"). The vertical projections 32*a-d* are manufactured with external threads 34, sized and shaped to threadedly engage existing inner threads of the horizontal leveling device 56 (e.g., tensioning element such as a threaded nut), as shown, for example, in FIG. 4. In use, continued engagement of the external threads 34 of the stem portion 30 of the tile leveling device 10 with the internal threads of the horizontal leveling device 56 provides an increasing downward pressure on the tiles 40. As shown, the horizontal leveling device 56 is embodied as a locking nut to effect a downward pressure on the tiles 40 thereby aligning the edges of the tiles 40 in the same plane with minimal or no slippage.

With continued reference to FIG. 1, a vertical leveling hand device 26 comprises a stem gripping portion 27 for gripping the stem, and an engagement portion 28 for engagement with the central orifice 38 of the tile leveling device 10. In use, engagement of the vertical leveling hand device 26 with the tile leveling device 10 imparts a vertical force on a portion of the floor or substrate 58 directly beneath the tiles 40 to be aligned causing the tiles 40 to be driven in the vertical direction thereby causing leveling of the tiles 40 so that adjacent tiles are leveled relative to themselves without regard to whether the substrate material is level. The force applied by the vertical leveling hand device 26 holds the tiles 40 at the same height so that corners and/or edges of the adjacent tiles 40 remain level in the setting bed 54 as the setting bed 54 dries and cures. After the setting bed dries, thereby securing the tiles 40 to the floor or substrate 58, the stem portion 30 can be separated from the bottom plate 20 leaving the bottom plate 20 beneath the set tiles.

Figure 5:
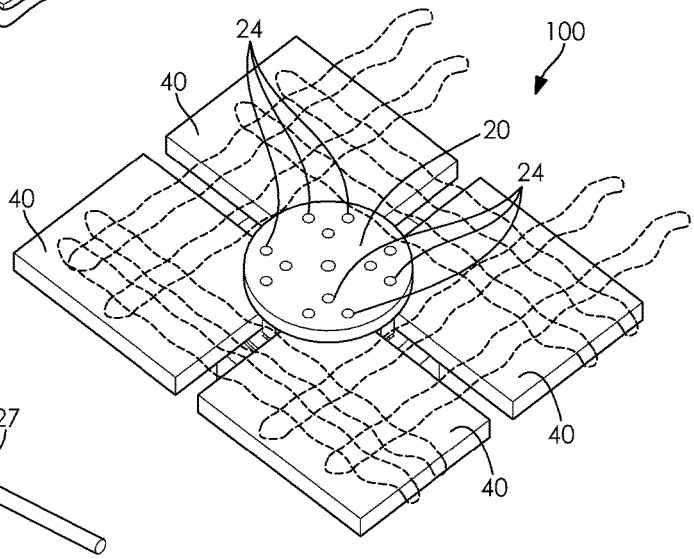
FIG. 5 is a bottom perspective view of the base portion of the tile leveling device according to one embodiment of the disclosure.

FIG. 5 is a bottom perspective view of the base portion 20 of the tile spacer device 10 placed in the setting bed 54. The base portion 20 of the tile spacer device 10 is in the form of a central circular disk arranged with a plurality of apertures 24 to allow adhesive to flow through the setting bed 54 for ease in leveling the tiles 40. The base portion 20 of the tile leveling device 10 is envisioned to be positioned in the setting bed 54 below the adjacent tiles 40 to remain permanently in place after setting of the tiles 40 to provide an invisible and consistent flooring installation. In other embodiments, the base portion 20 is envisioned to have shapes other than a central circular disk including, for example, round, square and rectangular shapes. As shown in FIG. 5, the base portion 20 engages the bottom surface of the tiles 40 to be aligned on the upper surface of the base portion 20.

In some embodiments, as described further below, the orifice 38 of the base portion 20 of the tile spacer device 10 and the vertical leveling hand device 26 may be non-threaded depending on the application.

Referring again to FIGS. 1-2, each of four tiles 40 abuts a corner of two vertical projections 32*a-d* (formed between arms of the cross) of the stem portion 30 to space the four tiles 40 at a predetermined distance with respect to each other. The dimensions of the vertical projections 32*a-d* ensure that when the tiles 40 are engaged they will be correctly spaced with respect to each other. In each device 10, the tile vertical projections 32*a-d* are manufactured to the same width, e.g., 1/16". Other device 10 widths contemplated for use with different sized grout joints are 1/8", 3/16", 1/4" and 1/2". As shown in FIG. 1, a breakaway section 36 is defined at the tile bottom surface engagement portion 20. The breakaway section 36 may be a frangible section of the four vertical projections 32*a-d* of reduced mass, for example, a plurality of holes as shown in FIG. 1, that would promote the breakaway when a negative pressure is applied such as when the horizontal leveling device (e.g., locking nut) 56 is tightened, thus causing a separation of the stem portion 30 from the base portion 20 of the tile spacer device 10.

Figure 2:
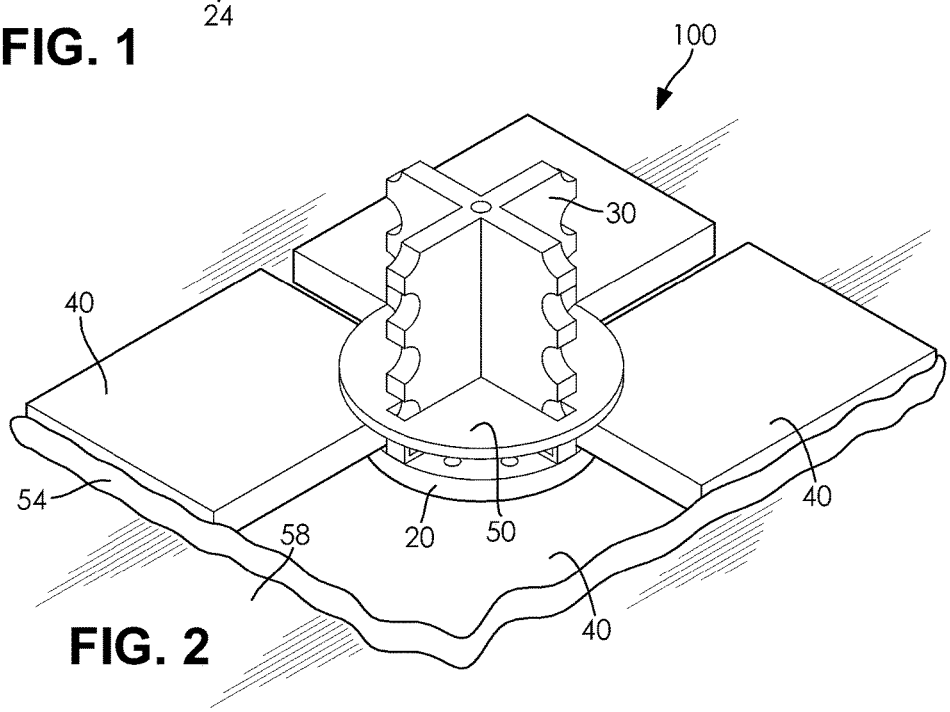
FIG. 2 is a perspective view of a tile leveler in use in accordance with an embodiment of the disclosure.

As shown in FIGS. 1 and 2, the threaded vertical leveling hand device 26 is shown having outer threads formed on an outer side of an engagement portion 28, the engagement portion 28 shaped and sized to threadedly engage the mutually aligned threaded orifices 38 of both the stem portion 30 and the base portion 20 of the tile leveling device 10. In some embodiments, the vertical leveling hand device 26 can be a push-bar, T-bar or the like. In some embodiments, the vertical leveling hand device 26 is not threaded, for those application in which the tiles are very closely spaced (e.g., small grout), or for a soft floor or substrate 58 as will be described below in detail with reference to FIG. 7.

In an embodiment, a method for aligning and leveling a plurality of tiles includes a first step of applying a setting bed 54, such as a cement or mortar compound, to the substrate surface 58. A plurality of tile spacer devices 10 are then positioned in the setting bed 54. Thereafter, the tiles 40 can be placed around each tile spacer device 10 in the setting bed 54 beneath the tiles 40 so that the spacer members 30 extend upward between the adjacent tiles 40, as best shown in FIGS. 2 and 5. The base portions 20 of the tile spacer devices 10 are preferably positioned so that they are in contact with more than one tile.

After the tile spacer devices 10 have been positioned in the setting bed 54, a user may perform the optional step of placing slip ring/spacers 50 over the respective stem portions 30 of the tile spacer devices 10, after the tile spacer device 10 has been embedded in the setting bed 54 to eliminate any horizontal shifting of the tiles as they are being horizontally aligned by the horizontal leveling device 56 (e.g., locking nut).

Figure 3A:
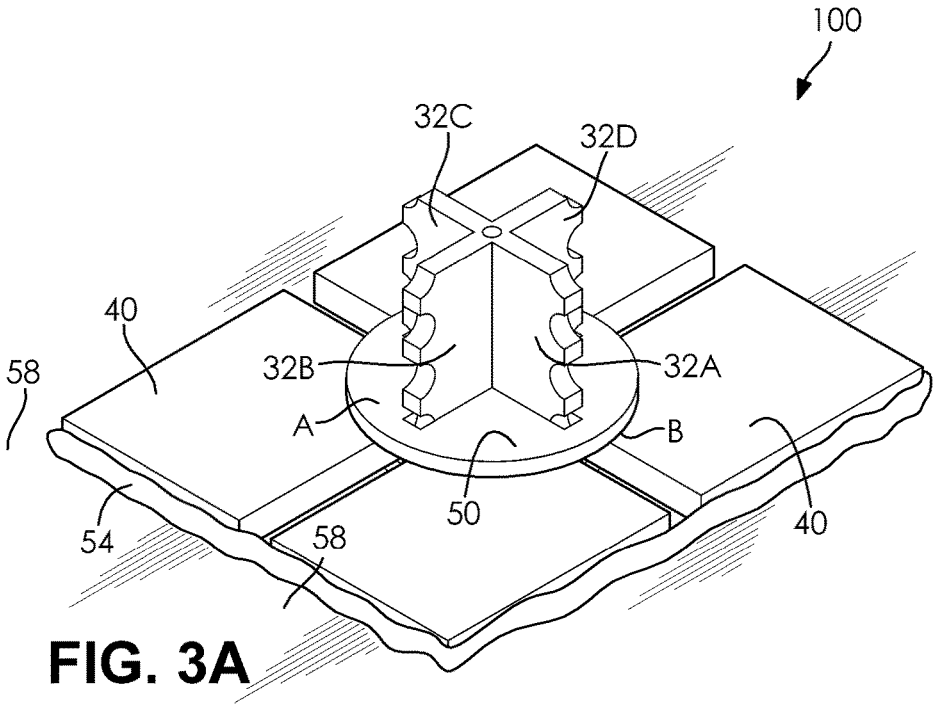
FIG. 3A is a perspective view of the spacer member of the tile leveler and a slip ring/spacer which slides over the spacer member in accordance with an embodiment of the disclosure.
Figure 3B:
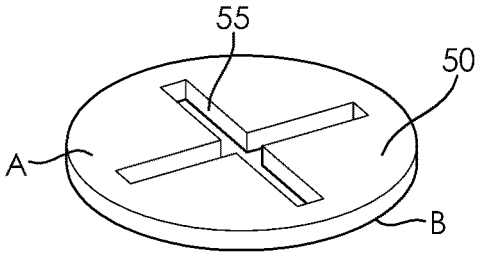
FIG. 3*b* is a top perspective view of the slip ring/spacer of FIG. 3A according to one embodiment of the disclosure.
Figure 3C:
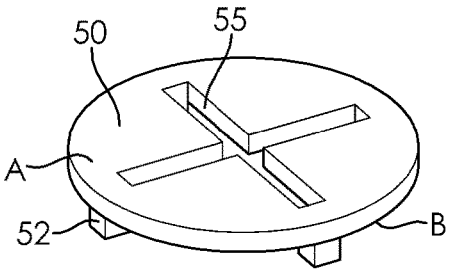
FIG. 3*c* illustrates an additional detail of the slip ring/spacer of FIGS. 3*a*-3*b;*
Figure 3D:
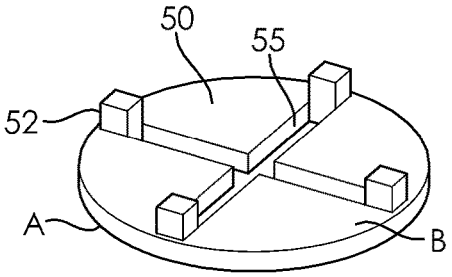
FIG. 3*d* illustrates the lower side of the slip ring/spacer of FIGS. 3*a*-3*c;*

Further structural details of the slip ring/spacer 50 are depicted in FIGS. 3A-3D. The slip ring/spacer 50 is preferably made from a non-conductive material such as a smooth hard plastic and may comprise a circular disk including one or more through slits 55 to slip over a corresponding vertical leg 34*a-d* of the spacer members 30. In the case of leveling four (4) vertical legs 34*a-d*, the through slits 55 of the slip ring/spacer 50 form a hollowed cruciform or cross-shaped configuration (i.e., + sign), as shown in FIGS. 3*b-d*.

The slip ring/spacer device 50, as its name implies, is configured to serve the dual functions of a slip ring and a tile spacer when oriented in a first orientation and solely as a spacer in a second orientation. As shown in FIGS. 3*c* and 3*d*, the slip ring/spacer device 50 comprises four integrally molded raised protrusions 52 formed at a bottom "B" side of the slip ring/spacer 50. The raised protrusions 52 have a common length and are circumferentially and equidistantly space about the periphery of the bottom "B" side of the slip ring/spacer device 50. When the device is used both as a slip ring and spacer, a bottom or "B" side of the circular slip ring/spacer device disk faces in a downward direction (i.e., the "B" side facing toward the setting bed 54). In this manner, the two (or four) vertical raised protrusions 52 are of a sufficient width so as to override the spacing which is otherwise provided by the four vertical projections 32*a-d* of the tile leveling device 10. The vertical protrusion widths may be manufactured to various widths and heights. Typical widths contemplated by the present disclosure include 1/16", 1/8", 1/4", and 1/2". A typical height is substantially 1/8" but can be shorter or taller dependent upon the application.

In accordance with a method of operation, according to one embodiment, after the slip ring/spacer 50 is placed over the stem portion 30 of tile spacer device 10, the horizontal leveling device 56 is then placed over the slip ring/spacer 50 and is threadedly engaged with the outer threads 34 of the four vertical projections 32*a-d* of the stem portion 30 of the tile spacer device 10. Upon engaging the horizontal leveling device 56 over the tiles 40, the horizontal leveling device 56 is turned in a clockwise or counterclockwise direction, dependent upon the threading arrangement, thereby causing a downward pressure to be exerted on the tiles 40 underneath which causes the edges/and or surfaces of the tiles 40 to be aligned in the same plane with minimal or no slippage. Thereafter, with the tiles aligned, the locking nut 56 remains in place and a threaded engagement portion 28 of a vertical leveling hand device 26 is inserted into the threaded orifice 38 of the tile spacer device 10 and turned in one of a clockwise or counterclockwise direction to align the tiles 40 vertically with respect to the floor or substrate 58 by exerting a downward force against the floor or substrate 54. The alignment may be verified by using a conventional leveling measurement device. Further alignment may be achieved by continued turning of the vertical leveling hand device 26 in either the clockwise or counterclockwise direction.

Figure 4:
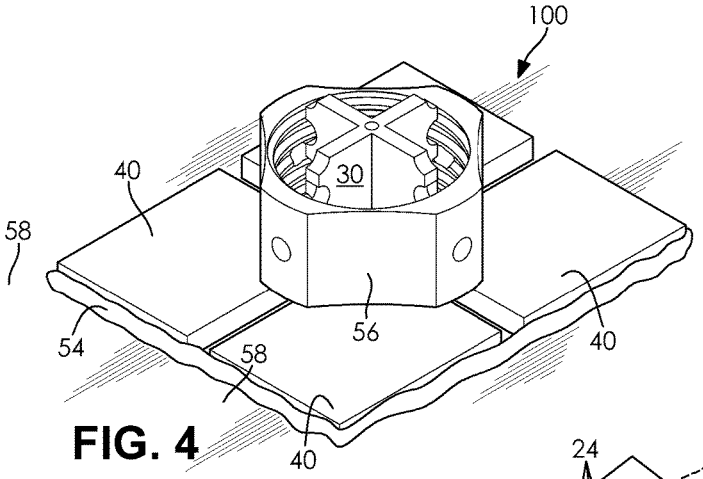
FIG. 4 is a perspective view of the tile leveling system in use according to one embodiment of the disclosure.
Figure 6:
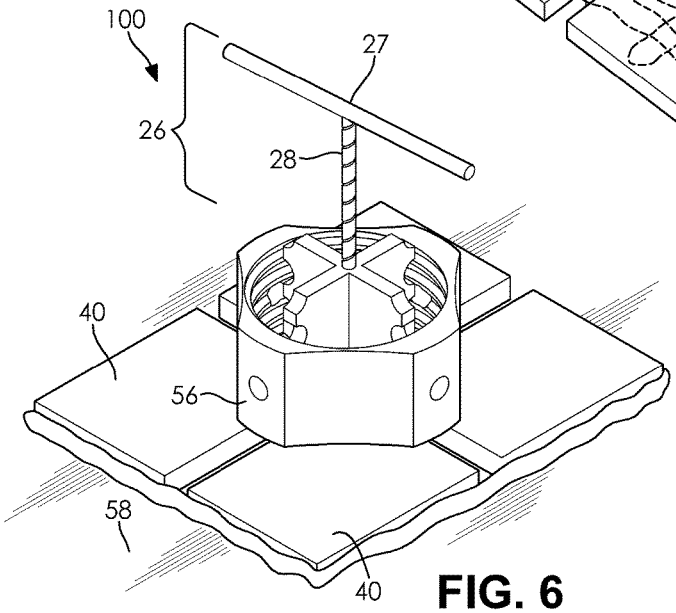
FIG. 6 is a perspective view of the tile device including the vertical tile leveling hand device in accordance with an embodiment of the disclosure.

The horizontal leveling device 56, can be, for example, a locking nut, which in a preferred embodiment is a hexagonal locking nut, as shown, for example, in FIGS. 4 and 6. The hexagonal shape is a preferred shape for the horizontal leveling device 56 as its hexagonal shape assists in rotating the nut around the four vertical projections 32*a-d* of the spacer member 30 of the tile leveling device 10. Other types of locking nuts for use as a horizontal leveling device 56, such as, for example, hard locking bearing nut, fine U nuts, and precision lock nuts are contemplated.

Once the tiles 40 have been placed in vertical and horizontal alignment, the vertical leveling hand device 26 and horizontal leveling device 56 (e.g., locking nut) are removed from the tile spacer 10. Thereafter, once it has been determined that the setting bed has dried, the stem portion 30 may be separated from the base portion 20 of the tile spacer devices 10 leaving the base portions 20 beneath the tiles 40.

Figure 7:
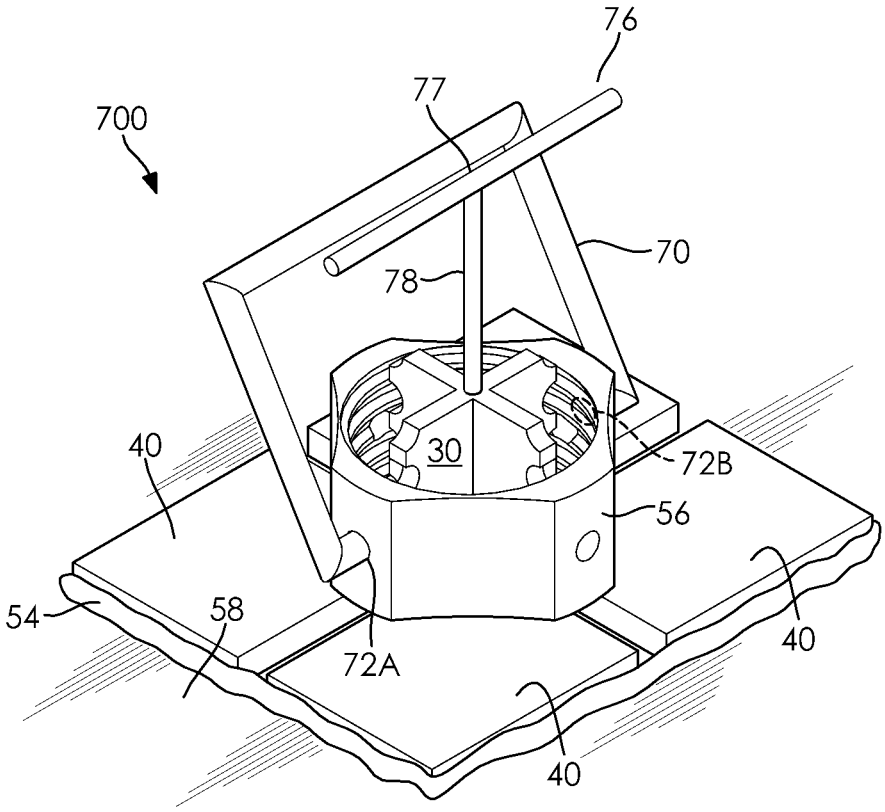
FIG. 7 is a perspective view of a U-bar assist device to assist the vertical tile leveling hand device in leveling the tiles accordance with an embodiment of the disclosure.

FIG. 7 shows an alternate embodiment of the tile leveling and aligning system 700 for use for those applications in which the tiles are very closely spaced (e.g., small grout) and/or when tiles are being laid over a soft substrate, such as plywood. In this embodiment, a U-bar 70 is used as a leveraging device with a non-threaded version of the vertical leveling hand device (T-bar) 76 for closely spaced tile and/or soft substrate applications. Using the vertical leveling hand device (T-bar) 76 without the U-bar 70 is not recommended for closely spaced tile and/or soft substrate applications because turning the vertical leveling hand device (T-bar) 76 can cause an undesirable penetration of the soft substrate beneath the tiles 40 due to the close tile spacing without actually assisting in lifting the tiles as desired. This embodiment overcomes the afore-mentioned problems by using the U-bar 70 and the vertical leveling hand device (T-bar) 76 in unison to apply a combined downward pressure resulting in a lifting force on the tiles which removes or minimizes any undesirable penetration of the substrate for closely spaced tile applications. Similarly, applying a combined upward pressure causes the tiles to move vertically higher as needed.

In accordance with the presently described embodiment, a vertical leveling hand device (e.g., T-bar) 76 includes a grip portion 77 and a non-threaded stem portion 78. Notably, the orifice 38 of the stem portion 30 of the tile leveling device 10 is also non-threaded in this embodiment. With the locking nut 56 secured in place, the T-bar 76 is inserted into the non-threaded orifice 38 of the stem portion 30 of the tile leveling device 10 without applying any force. Thereafter, the U-bar 70 is secured to the locking nut 56 at securing points 72*a* and 72*b*. Notably, the order of operation of insertion of the vertical leveling hand device (T-bar) 76 and securing the U-bar 70 to the locking nut 56 may be performed in any order.

With the vertical leveling hand device (e.g., T-bar) 76 and the U-bar 70 elements in place, a user, using the palm of the hand, would apply a downward force directly to the vertical leveling hand device (T-bar) 76 and simultaneously apply un upward force on the U-bar 70 using the fingers of the same hand so that the tiles 40 together with the locking nut 56 are collectively pulled in an upward direction until vertical alignment occurs. It is therefore appreciated that a lifting action of the tiles is achieved without the need to turn the vertical leveling hand device (T-bar) 76 and risk penetration of the substrate.

Figure 8A:
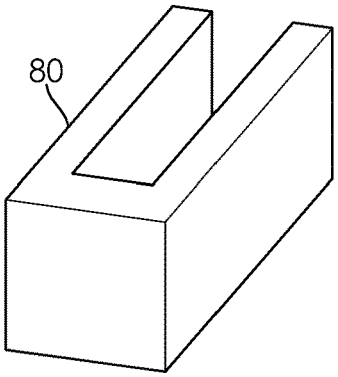
FIGS. 8*a-d* are perspective views of an alternate spacer device in accordance with an alternate embodiment of the disclosure.
Figure 8B:
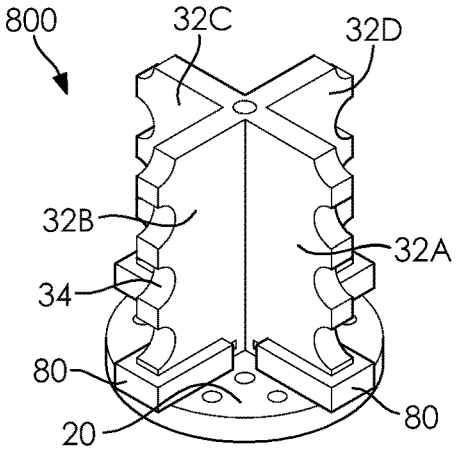
Figure 8C:
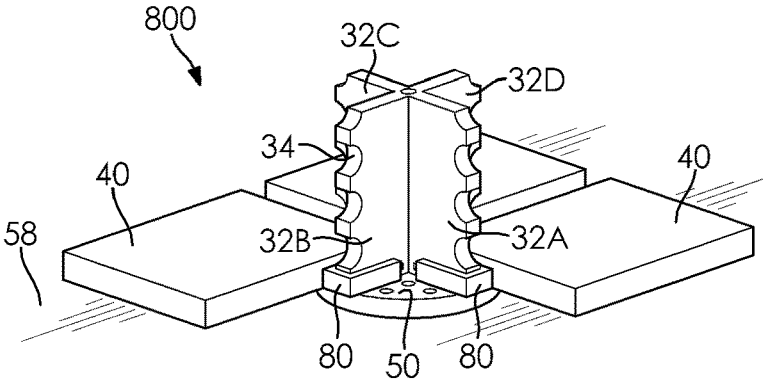
Figure 8D:
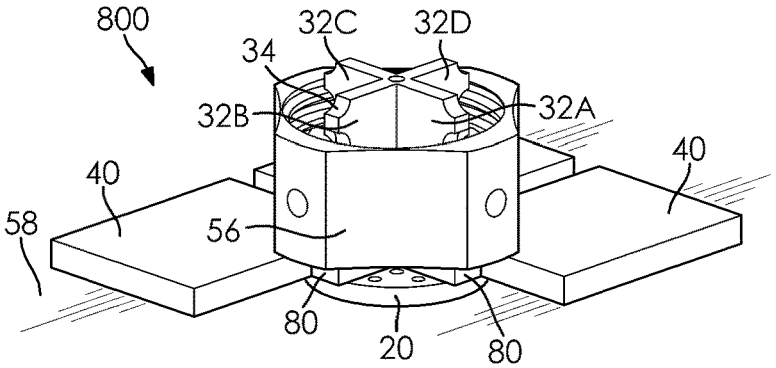

Referring now to FIGS. 8*a-d*, there is shown a further embodiment of a tile leveling and alignment system 800 providing an alternate grout spacer device 80 that may be used in lieu of the protrusions 55 of the slip ring 50, as described above with respect to FIGS. 3C and 3D, and in lieu of the four vertical projections 32*a-d* (i.e., spacer fins) of the stem portion 30 of the tile leveling device 10. As best shown in FIG. 8*a*-8*c*, the alternate grout spacer device 80 comprises a U-shaped insertion element that is inserted over each of the outer threads 34 of the four vertical projections 32*a-d* (i.e., spacer fins) of the stem portion 30 at the base 20 of the tile spacer device 10. In this manner, the thickness of the alternate grout spacer device 80 defines the grout spacing of the tiles, essentially overriding the grout spacing provided by the four vertical projections 32*a-d*.

The alternate grout spacer 80 can be manufactured to various thicknesses to accommodate a wide variety of tile grout spacing. Notably, for those applications where both the alternate grout spacer 80 and the slip ring/spacer device 50 are used, the slip ring spacer device 50 would not serve as a grout spacer and would instead be oriented in a manner to function exclusively as a slip ring, i.e., with the vertical protrusions 52 facing the substrate (i.e., "B" side down), as shown in FIG. 3*c*. As stated above, the slip ring/spacer device 50 is an optional device and may or may not be used in certain applications.

As described above, three independent options for grout spacing are provided according to the present disclosure. A first option is provided by the width of the vertical projections 32*a-d* of the stem portion 30 of the tile spacer device. A second option is provided by the slip ring/spacer device 50. A third option is provided by the alternate grout spacer 80.

Figure 9A:
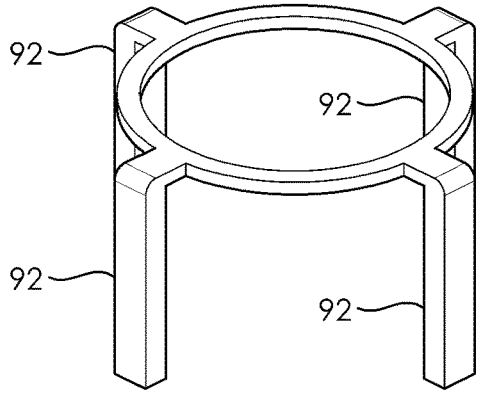
FIG. 9*a-c* are perspective views of an alternate vertical tile leveling device in accordance with an alternate embodiment of the disclosure.
Figure 9B:
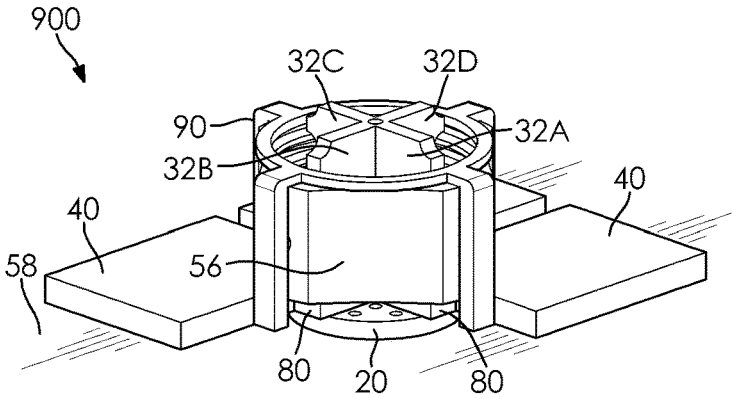
Figure 9C:
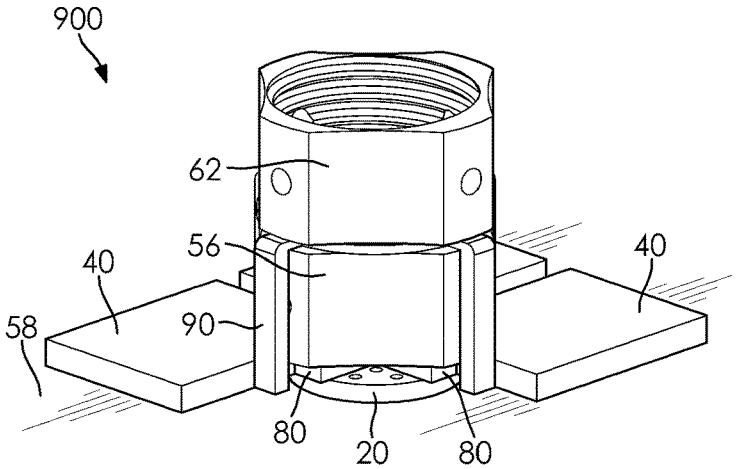

FIGS. 9*a-c* show an alternate embodiment of a tile leveling and alignment system 900 including an alternate vertical leveling hand device 90 comprising a ring-shaped element comprising four integral vertical legs 92 having an equidistant relative spacing on the ring. In use, as shown in FIG. 9*b*, the alternate vertical tile leveling device 90, is placed over the first nut 56 and lies approximately 1/4" above the first nut 56. Once in place, a second locking nut 62 is placed over the vertical tile leveling device 90 with the legs 92 of the vertical tile leveling device 90 being positioned between the tiles 40 into the grout line and rest on the solid floor or substrate as a second locking nut 62 is engaged. The second locking nut 62 engages the outer threads 34 of the four vertical projections 32*a-d* of the stem portion 30, as shown in FIG. 9*c*. As the second nut 62 is being engaged, it will come into contact with the alternate vertical tile leveling device 90. Once contact is achieved, further engagement of the second nut 62 will cause the tile space device 10 together with the first nut 56 to travel upwards thereby lifting up the tiles 40 until vertical leveling is achieved.

It is envisioned that other styles and configurations of the present system can be easily incorporated into the teachings of the present disclosure, and only one particular configuration shall be shown and described for purposes of clarity and disclosure and not by way of limitation of scope.

Embodiments of the present system can be utilized by the common user in a simple and effortless manner with little or no training. After initial purchase or acquisition of the system, it would be installed as indicated in FIGS. 1-9C.

One of ordinary skill in the art would understand that a plurality of tile alignment and leveling devices can be simultaneously used between different tiles being laid on a substrate so as to level many tiles at the same time.

In view of the foregoing disclosure, referring to FIGS. 1-9C, those skilled in the art will recognize and understand that the present disclosure relates to a tile leveling and aligning system, e.g., tile leveling and aligning system (100), including a main body comprising a base portion (20) integrally coupled to a stem portion (30), the base portion (20) adapted for engaging a bottom surface of a number of tiles (40) to be leveled and aligned, the stem portion (30) projecting upwards from the base portion (20) and having one or more spacer legs (32) extending transversely from a center aperture (38) of said stem portion (30), each spacer leg (32) having a series of external threads (34) integrally formed on an outer face, the one or more spacer legs (32) dividing the base portion (20) into equal sized areas of common shape, each of the equal sized areas adapted to receive a corner of one of the tiles to be leveled and aligned (40), each spacer leg (32) defining a joint width between adjacent tiles to be leveled and aligned (40), a horizontal leveling device (56) for engaging a top surface of the number of tiles to be horizontally leveled and aligned (40), the first horizontal leveling device (56) adapted and configured to engage the spacer legs (32) formed on the outer face of the stem portion (30) of the tile leveling and aligning device (10), the engagement resulting in a single connected assembly comprising the tile leveling and aligning device (10), the horizontal leveling device (56) and the number of tiles to be leveled and aligned (40), and a vertical leveling hand device (26) adapted for imparting a vertical force on a substrate (54) beneath the number of tiles to be leveled and aligned (40), the vertical force causing the assembly to be driven upwards away from the substrate (58) resulting in a vertical alignment of the tiles.

The base portion (20) of the tile leveling and aligning device may be in the form of a central circular disk and includes a plurality of apertures to allow adhesive to flow through the base during an alignment phase to allow a bottom surface of the number of tiles to be leveled and aligned to engage a top surface of the base portion.

In one embodiment, the one or more spacer legs (32) of the stem portion (30) are equidistantly located at ninety degree (90°) angles from each other in the case where four spacer legs are used.

In one embodiment, the spacer legs (32) of the stem portion (30) are equidistantly located at one hundred and eighty degree (180°) angles from each other in the case where two spacer legs are used.

In one embodiment, the spacer legs (32) of the stem portion (30) include a breakaway section to facilitate breakaway from the base portion (20) after the tiles to be leveled and aligned (40) have been set.

In one embodiment, the horizontal leveling device (56) is adapted to apply a circular or rotational horizontal leveling force directly to the spacer legs (32) of the stem portion (30) of the tile leveling and aligning device (10) causing the top of the tiles to be leveled and aligned (40) to be drawn down into a properly spaced relative horizontal arrangement with minimal or no slippage.

In one embodiment, the first horizontal leveling device (56) is a threaded locking nut. In one embodiment, the threaded locking nut is one of a hard locking bearing nut, a fine U nut, and a precision lock nut.

In one embodiment, the vertical leveling hand device (26) comprises a stem gripping portion (27) for gripping the stem portion of the tile leveling device and an engagement portion (28) for engagement with a corresponding stem receiving portion (38) of the tile leveling and aligning device (10).

In one embodiment, the vertical hand leveling device is a threaded T-bar (26). In another embodiment, the vertical hand leveling device is a non-threaded T-bar (76).

In one embodiment, the tile leveling and aligning system further comprises a U-bar (70) configured as an assist device for assisting the user in using the non-threaded T-bar (76). In one embodiment, the tile leveling and aligning system further comprises a slip ring/spacer device (50) adapted for use as a multi-functional spacing element and slip ring element, wherein the spacing element is adapted to horizontally space the tiles to be leveled and aligned (40), and the slip ring element is adapted to eliminate horizontal shifting of the tiles to be leveled and aligned (40) as they are being horizontally aligned by the first horizontal leveling device (56).

In one embodiment, the slip/ring spacer device (50) comprises a circular disk including on a top ("A") side, a hollowed cross-sectional area and on a bottom ("B") side, four integrally molded raised the protrusions having a common length circumferentially and equidistantly spaced about the periphery of the bottom ("B") side.

In one embodiment, the slip/ring spacer device (50) is made of a non-conductive material, and has an external cylindrical shape including one or more through slits (55) to slip over the one or more vertical legs (32) of the spacer member (30).

In one embodiment, the tile leveling and aligning system further comprises a spacer device (80) comprising a U-shaped insertion element configured to be inserted over each of the outer threads (34) of each vertical projection (32) of the stem portion (30) of the tile leveling and aligning device (10).

The present disclosure relates also to a tile leveling and aligning system, e.g., tile leveling and aligning system 900, comprising a device (10) comprising a main body comprising a base portion integrally coupled to a stem portion, the base portion (20) adapted for engaging a bottom surface of a number of tiles to be leveled and aligned (40), the stem portion (30) projecting upwards from the base portion (20) and having one or more spacer legs (32) extending transversely from a center aperture (38) of the stem portion (30), each spacer leg (32) having a series of external threads (34) integrally formed on an outer face, the one or more spacer legs (32) dividing the base portion (20) into equal sized areas of common shape, each of the equal sized areas adapted to receive a corner of one of the tiles to be leveled and aligned (40), each spacer leg (32) defining a joint width between adjacent tiles to be leveled and aligned (40), a first horizontal leveling device (56) for engaging a top surface of the number of tiles to be horizontally leveled and aligned (40), the first horizontal leveling device (56) adapted and configured to engage the spacer legs (32) formed on said outer face of the stem portion (30) of the universal tile leveling and aligning device (10), the engagement resulting in a single connected assembly comprising the tile leveling and aligning device (10), the horizontal leveling device (56) and the number of tiles to be leveled and aligned (40), a vertical leveling hand device (90) comprising a ring-shaped element including four integrally connected vertical legs (92) having an equidistant relative spacing on the ring-shaped element, the vertical leveling hand device (90) adapted to be placed over the first horizontal leveling device (56), and a second horizontal leveling device (62) for placement over the second vertical leveling hand device, the second horizontal leveling device (62) adapted and configured to engage a top portion of the spacer legs formed on the outer face of the stem portion of the tile leveling and aligning device, the engagement resulting in a single connected assembly comprising the second horizontal leveling device (62), the second vertical leveling hand device (90), the first horizontal leveling device (56) and the number of tiles to be leveled and aligned (40).

The tile leveling and aligning system may further include a slip ring/spacer device (50) adapted for use as a multi-functional spacing element and slip ring element, wherein the slip ring/spacer device (50) is adapted for use, in one aspect, as a spacing element to horizontally space the tiles to be leveled and aligned (40), and wherein the slip ring/spacer device (50) is further adapted for use, in another aspect, as a slip ring element to eliminate horizontal shifting of the tiles to be leveled and aligned (40) as they are being horizontally aligned by the first horizontal leveling device (56), wherein the slip/ring spacer device comprises a circular disk including on a first ("A") side, a hollowed cross-sectional area and on a second ("B") side, four integrally molded raised the protrusions (52) having a common length circumferentially and equidistantly spaced about the periphery of the second ("B") side.

In one embodiment, the slip ring (50) is made of a non-conductive material, and has an external cylindrical shape including one or more through slits (55) to slip over the one or more vertical legs (32) of the spacer member (30).

In one embodiment, the tile leveling and aligning system further comprises a spacer device comprising a U-shaped insertion element configured to be inserted over each of the outer threads (34) of each vertical projection (30) of the stem portion (30) of the tile leveling and aligning device (10).

The present disclosure also relates to a method for aligning and leveling tiles being secured to a suitable substrate, comprising: applying a setting bed, placing a plurality of tiles in the setting bed, positioning a tile device at an intersection of one of: two, three or four adjacent tiles in the setting bed, such that each tile abuts a corner of a stem portion of the tile device thereby spacing the two, three or four adjacent tiles to be aligned at a predetermined distance with respect to each other, using a horizontal leveling device to apply a circular or rotational horizontal leveling force to the stem portion of the tile device, to cause the top of the tiles to be horizontally aligned together in the same plane with minimal or no slippage, using a vertical leveling hand device to apply a vertical force to the substrate beneath the tiles to be leveled resulting in a counter force thereby lifting or lowering the tiles in a vertical plane to cause a vertical alignment of the tiles, and applying a further rotational force to the horizontal leveling device to cause the stem portion to separate from the base portion leaving the base portion beneath the set tiles.

It should be noted that the features illustrated in the drawings are not necessarily drawn to scale, and features of one embodiment may be employed with other embodiments as the skilled artisan would recognize, even if not explicitly stated herein. Descriptions of well-known components may be omitted so as to not unnecessarily obscure the embodiments.

The foregoing descriptions of specific embodiments of the present disclosure have been presented for purposes of illustration and description. They are not intended to be exhaustive or to limit the present disclosure and method of use to the precise forms disclosed. Obviously many modifications and variations are possible in light of the above teaching. The embodiment was chosen and described in order to best explain the principles of the present disclosure and its practical application, and to thereby enable others skilled in the art to best utilize the present disclosure and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure.

While multiple embodiments are disclosed, still other embodiments of the present disclosure will become apparent to those skilled in the art from this detailed description. The present disclosure is capable of myriad modifications in various obvious aspects, all without departing from the spirit and scope of the present disclosure. Accordingly, the drawings and descriptions are to be regarded as illustrative in nature and not restrictive.

While the above description contains many specifics, these specifics should not be construed as limitations of the present disclosure, but merely as exemplifications of preferred embodiments thereof. Those skilled in the art will envision many other embodiments within the scope and spirit of the present disclosure as defined by the claims appended hereto.

Where this application has listed the steps of a method or procedure in a specific order, it may be possible, or even expedient in certain circumstances, to change the order in which some steps are performed, and it is intended that the particular steps of the method or procedure claim set forth herein below not be construed as being order-specific unless such order specificity is expressly stated in the claim.

The present disclosure has several preferred embodiments but they are not exclusive. The present disclosure is susceptible of many embodiments, all of which are within the scope of the appended claims. All the details may be substituted by other equivalent elements.

What is claimed is:

1. A tile leveling and aligning system, comprising:

a tile leveling and aligning device comprising a main body further comprising a base portion integrally coupled to a stem portion, the base portion adapted for engaging a bottom surface of a number of tiles to be leveled and aligned, the stem portion projecting upwards from the base portion and having one or more spacer legs extending transversely from a center aperture of the stem portion, the one or more spacer legs having a series of external threads integrally formed on an outer face of the one or more spacer legs, the one or more spacer legs dividing the base portion into equal sized areas of common shape, each of the equal sized areas adapted to receive a corner of one of the tiles to be leveled and aligned, the one or more spacer legs defining a joint width between adjacent tiles to be leveled and aligned, a horizontal leveling device for engaging a top surface of the number of tiles to be horizontally leveled and aligned, the horizontal leveling device adapted and configured to engage the series of external threads integrally formed on the outer face of the one or more spacer legs formed on the outer face of the one or more spacer legs extending transversely from a center aperture of the stem portion of the tile leveling and aligning device, the engagement resulting in a single connected assembly comprising the tile leveling and aligning device, the horizontal leveling device and the number of tiles to be leveled and aligned, and a vertical leveling hand device adapted for imparting a vertical force on a substrate beneath the number of tiles to be leveled and aligned, the vertical force causing the single connected assembly to be driven upwards away from the substrate resulting in a vertical alignment of the tiles to be leveled and aligned.

2. The tile leveling and aligning system of claim 1, wherein the base portion of the tile leveling and aligning device is in the form of a central circular disk and includes a plurality of apertures to allow adhesive to flow through the base during an alignment phase to allow a bottom surface of the number of tiles to be leveled and aligned to engage a top surface of the base portion.

3. The tile leveling and aligning system of claim 1, wherein the one or more spacer legs of the stem portion are equidistantly located at ninety degree (90°) angles from each other in the case where four spacer legs are used.

4. The tile leveling and aligning system of claim 1, wherein the one or more spacer legs of the stem portion are equidistantly located at one hundred and eighty degree (180°) angles from each other in the case where two spacer legs are used.

5. The tile leveling and aligning system of claim 1, wherein the one or more spacer legs of the stem portion include a breakaway section to facilitate breakaway from the base portion after the tiles to be leveled and aligned have been set.

6. The tile leveling and aligning system of claim 1, wherein the horizontal leveling device is adapted to apply a circular or rotational horizontal leveling force directly to the one or more spacer legs of the stem portion of the tile leveling and aligning device causing the top of the tiles to be leveled and aligned to be drawn down into a properly spaced relative horizontal arrangement with minimal or no slippage.

7. The tile leveling and aligning system of claim 1, wherein the horizontal leveling device is a threaded locking nut.

8. The tile leveling and aligning system of claim 7, wherein the threaded locking nut is one of a hard locking bearing nut, a fine U nut, and a precision lock nut.

9. The tile leveling and aligning system of claim 1, wherein the vertical leveling hand device comprises a stem gripping portion for gripping the stem portion of the tile leveling device and an engagement portion for engagement with a corresponding stem receiving portion of the tile leveling and aligning device.

10. The tile leveling and aligning system of claim 9, wherein the vertical hand leveling device is a threaded T-bar.

11. The tile leveling and aligning system of claim 9, wherein the vertical hand leveling device is a non-threaded T-bar.

12. The tile leveling and aligning system of claim 11, further comprising a U-bar configured as an assist device for assisting the user in using the non-threaded T-bar.

13. The tile leveling and aligning system of claim 1, further comprising:

a slip ring/spacer device adapted for use as a multi-functional spacing element and slip ring element, wherein the spacing element is adapted to horizontally space the tiles to be leveled and aligned, and wherein the slip ring element is adapted to eliminate horizontal shifting of the tiles to be leveled and aligned as they are being horizontally aligned by the first horizontal leveling device, wherein the slip/ring spacer device comprises a circular disk including on a top ("A") side, a hollowed cross-sectional area and on a bottom ("B") side, four integrally molded raised protrusions having a common length circumferentially and equidistantly spaced about the periphery of the bottom ("B") side.

14. The tile leveling and aligning system of claim 13, wherein the slip ring element is made of a non-conductive material, and has an external cylindrical shape including one or more through slits to slip over the one or more vertical legs of the spacer member.

15. The tile leveling and aligning system of claim 1, further comprising a spacer device comprising a U-shaped insertion element configured to be inserted over each of the external threads of one or more vertical projections of the stem portion of the tile leveling and aligning device.

16. A tile leveling and aligning system, comprising:

a tile leveling and aligning device comprising a main body comprising a base portion integrally coupled to a stem portion, the base portion adapted for engaging a bottom surface of a number of tiles to be leveled and aligned, the stem portion projecting upwards from the base portion and having one or more spacer legs extending transversely from a center aperture of the stem portion, one or more spacer legs having a series of external threads integrally formed on an outer face of the one or more spacer legs, the one or more spacer legs dividing the base portion into equal sized areas of common shape, each of the equal sized areas adapted to receive a corner of one of the tiles to be leveled and aligned, each spacer leg defining a joint width between adjacent tiles to be leveled and aligned, a first horizontal leveling device for engaging a top surface of the number of tiles to be horizontally leveled and aligned, the first horizontal leveling device adapted and configured to engage the series of external threads integrally formed on the outer face of the one or more spacer legs formed on the outer face of the stem portion of the tile leveling and aligning device, the engagement resulting in a single connected assembly comprising the tile leveling and aligning device, the horizontal leveling device and the number of tiles to be leveled and aligned, a vertical leveling hand device comprising a ring-shaped element including four integrally connected vertical legs having an equidistant relative spacing on the ring-shaped element, the vertical leveling hand device adapted to be placed over the first horizontal leveling device, and a second horizontal leveling device for placement over the vertical leveling hand device, the second horizontal leveling device adapted and configured to engage a top portion of the spacer legs formed on the outer face of the stem portion of the tile leveling and aligning device, the engagement resulting in a single connected assembly comprising the second horizontal leveling device, the vertical leveling hand device, the first horizontal leveling device and the number of tiles to be leveled and aligned.

17. The tile leveling and aligning system of claim 16, further comprising:

a slip ring/spacer device adapted for use as a multi-functional spacing element and slip ring element, wherein the slip ring/spacer device is adapted for use as a spacing element to horizontally space the tiles to be leveled and aligned, and wherein the slip ring/spacer device is further adapted for use as a slip ring element to eliminate horizontal shifting of the tiles to be leveled and aligned as they are being horizontally aligned by the first horizontal leveling device, wherein the slip ring/spacer device comprises a circular disk including on a first ("A") side, a hollowed cross-sectional area and on a second ("B") side, four integrally molded raised protrusions having a common length circumferentially and equidistantly spaced about the periphery of the second ("B") side.

18. The tile leveling and aligning system of claim 17, wherein the slip ring element is made of a non-conductive material, and has an external cylindrical shape including one or more through slits to slip over the one or more vertical legs of the spacer member.

19. The tile leveling and aligning system of claim 16, further comprising a spacer device comprising a u-shaped insertion element configured to be inserted over each of the external threads of one or more vertical projections of the stem portion of the tile leveling and aligning device.

20. A method for aligning and leveling tiles being secured to a suitable substrate, comprising:

applying a setting bed, placing a plurality of tiles in the setting bed, positioning a tile device at an intersection of one of: two, three or four adjacent tiles in the setting bed, such that each tile abuts a corner of a base portion integrally coupled to a stem portion, the stem portion of the tile device thereby spacing the two, three or four adjacent tiles to be aligned at a predetermined distance with respect to each other, the stem portion projecting upwards from the base portion and having one or more spacer legs extending transversely from a center aperture of the stem portion, the one or more spacer legs having a series of external threads integrally formed on an outer face of the one or more spacer legs, the one or more spacer legs dividing the base portion into equal sized areas of common shape, each of the equal sized areas adapted to receive a corner of one of the tiles to be leveled and aligned, the one or more spacer legs defining a joint width between adjacent tiles to be leveled and aligned, using a horizontal leveling device to apply a circular or rotational horizontal leveling force to the stem portion of the tile device, to cause the top of the tiles to be horizontally aligned together in the same plane with minimal or no slippage, using a vertical leveling hand device to apply a vertical force to the substrate beneath the tiles to be leveled resulting in a counter force thereby lifting or lowering the tiles in a vertical plane to cause a vertical alignment of the tiles, and applying a further rotational force to the horizontal leveling device to cause the stem portion to separate from the base portion leaving the base portion beneath the set tiles.

* * * * *